US005505746A

United States Patent [19]

Chriswell et al.

[11] Patent Number: 5,505,746

[45] Date of Patent: Apr. 9, 1996

[54] METHOD OF TREATING COAL TO REDUCE SULPHUR AND CHLORINE EMISSIONS

[75] Inventors: Colin D. Chriswell, Slater; Josh A. O'Donnell, Huxley, both of Iowa

[73] Assignee: Iowa State University Research Foundation, Inc., Ames, Iowa

[21] Appl. No.: 213,976

[22] Filed: Mar. 15, 1994

[51] Int. Cl.[6] ..... C10L 9/00

[52] U.S. Cl. ..... 44/624; 44/622

[58] Field of Search ..... 44/622, 624, 604; 201/17

[56] References Cited

U.S. PATENT DOCUMENTS

| | | | |
|---|---|---|---|
| 4,092,125 | 5/1978 | Stambaugh et al. | 44/624 X |
| 4,148,613 | 4/1979 | Myers | 44/624 X |
| 4,167,397 | 9/1979 | Grant | 44/624 |
| 4,226,601 | 10/1980 | Smith | 44/604 X |
| 4,468,231 | 8/1984 | Bartok et al. | 44/604 |
| 4,886,519 | 12/1989 | Hayes et al. | 44/622 |

OTHER PUBLICATIONS

Daybell & Pringle, "The Mode of Occurrence of Chlorine in Coal," Fuel (1958) 37: 238–247 (month unknown).

*Primary Examiner*—Prince Willis, Jr.
*Assistant Examiner*—Cephia D. Toomer
*Attorney, Agent, or Firm*—Flehr, Hohbach, Test, Albritton & Herbert

[57] ABSTRACT

Methods and compositions are provided for treating coal to reduce the emissions of sulphur dioxide and hydrogen chloride gases upon combustion. In the subject method, coal is washed with a calcium anion wash solution, such as calcium hydroxide solution, and then separated from the wash solution. The treated coal exhibits reduced emissions of both sulphur dioxide and hydrogen chloride gas on combustion as compared with untreated coal.

10 Claims, 2 Drawing Sheets

METHOD OF TREATING COAL TO REDUCE SULPHUR AND CHLORINE EMISSIONS

TECHNICAL FIELD

The field of this invention is treatment of coal to reduce sulphur and chlorine emissions.

BACKGROUND OF THE INVENTION

Coal is a brown to black combustible rock which is used for a variety of applications, e.g., generating electrical power, in metallurgical production, in general industrial processes and in residential-commercial uses. Generally, coal is burned in fire-tube or water-tube boilers for generating steam that is, in turn, used to produce electricity, provide heat for factories and buildings and to provide steam for production processes.

Coal is mined in various geographical regions, including many regions of the United States. The composition of coal may vary considerably depending on the geographical region from which it is mined, and further may vary significantly within the same geographical region.

Depending on the particular region from which coal is obtained, coal may comprise various elements that, upon combustion, are emitted into the surrounding atmosphere as pollutant gases. The nature and amount of these gases will vary from one type of coal to another. For example, while coal from the Illinois basin releases a substantial amount of sulphur dioxide gas upon combustion, combustion of Wyoming coal yields a comparatively small amount of sulphur dioxide gas.

In view of increasing interest in protecting the environment from harmful pollutants, governmental regulations have been enacted to limit the amount of pollutants that may be released into the atmosphere upon combustion of coal. One such pollutant is sulphur dioxide gas. Sulphur is present in coal in two principle forms. These two forms are organic sulphur and inorganic sulphur compounds, e.g. iron pyrite. Upon combustion of coal that includes inorganic and organic sulphur compounds, sulphur dioxide emissions are released into the surrounding atmosphere. In order to comply with governmental regulations that limit the amount of sulphur dioxide emissions, coal that comprises high levels of sulphur must be treated in a manner that reduces the sulphur dioxide emissions to a level below that set by the governmental regulations. One treatment process that has found applicability in reducing the sulphur dioxide emissions following combustion of high sulphur containing coal is to coat the coal with calcium to form "clean coal." Upon combustion of calcium coated coal, the organic sulphur present in the coal reacts with the calcium to form calcium sulfate instead of sulphur dioxide. The resultant calcium sulfate remains in the coal ash with a concomitant reduction in sulphur dioxide emissions.

Another element present in some coals that gives rise to pollutant emissions upon combustion is chlorine. When chlorine is present in coal, it is present in three forms: as chloride ions dissolved in moisture present in the coal, chloride ions precipitated on the coal surface and as "organic chlorine." Organic chlorine is theorized to actually be chloride ions paired with positive groups on the coal surface. Upon combustion of coal comprising organic chlorine, hydrogen chloride gas is emitted into the atmosphere. This hydrogen chloride gas has been determined to be a pollutant, similar to sulphur dioxide gas. Governmental regulations are scheduled to take effect that will limit hydrogen chloride gas emissions upon combustion of coal comprising organic chlorine.

Although environmental regulations that limit the amount of pollutant gas emissions upon combustion of coal are effective in preserving the environment, they also make certain coal reserves in the United States unprofitable to exploit. For example, the coal reserve of the Illinois basin, which is the second largest coal reserve in the United States, comprises coal with comparatively high levels of both sulphur and chlorine. Thus, combustion of Illinois basin coal yields substantial emissions of both sulphur dioxide and hydrogen chloride gases. Because treatment processes for limiting the emissions of sulphur dioxide and hydrogen chloride gases are expensive, exploitation of Illinois basin coal has become increasingly unprofitable. It is often cheaper for many utilities, as well as other coal using groups, to comply with the government environmental regulations that limit emissions of these gases by switching to coals that include comparatively lower concentrations of sulphur and chlorine, such as Wyoming coal.

Thus, there is substantial interest in finding an economical treatment for coal that includes high concentrations of sulphur and chlorine which would reduce the resultant levels of both hydrogen chloride and sulphur dioxide emissions upon combustion. The ideal treatment would return those coal reserves rendered unprofitable through governmental regulation to profitability by a simple and economical procedure.

RELEVANT LITERATURE

Daybell and Pringel, Fuel (1958) 37:238–292, describe washing coal with an anionic solution in order to remove chlorine.

Chen et al., "Studies of Chlorine Removal from Coal: Hot Water Leaching and Heat Treatment," CRSC/EPRI First International Conference on Chlorine in Coal, Seminar 5, Oct. 11, 1989, Chicago, Ill., described washing coal with ammonium hydroxide solutions in order to remove "organic chlorine," i.e. chloride anions paired with organic positive groups.

SUMMARY OF THE INVENTION

Methods and compositions are provided for the treatment of coal comprising high levels of sulphur and chlorine. The subject method uses an ionic wash to treat the coal. During the wash process, chloride ions are replaced by the anions associated with the cation, and the cation is sorbed onto the coal surface. The resultant coal is a relatively clean burning coal that exhibits comparatively reduced sulphur dioxide and hydrogen chloride emissions upon combustion.

DESCRIPTION OF THE SPECIFIC EMBODIMENTS

Figure 1:
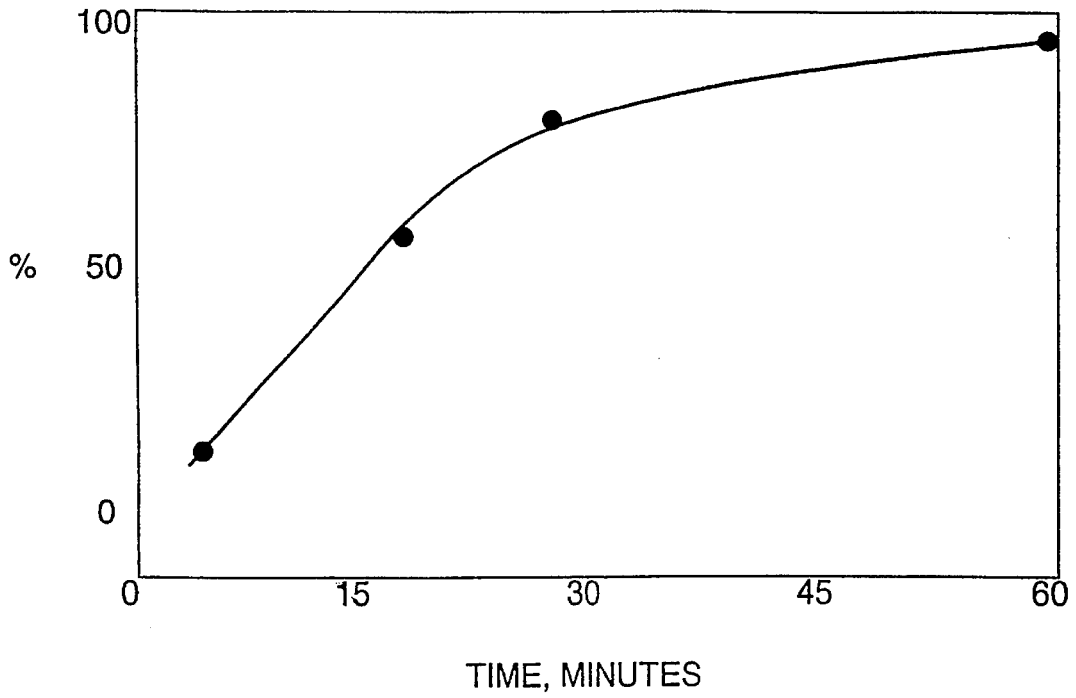
FIG. 1 is a graph depicting the effect of washing time on chlorine removal.
Figure 2:
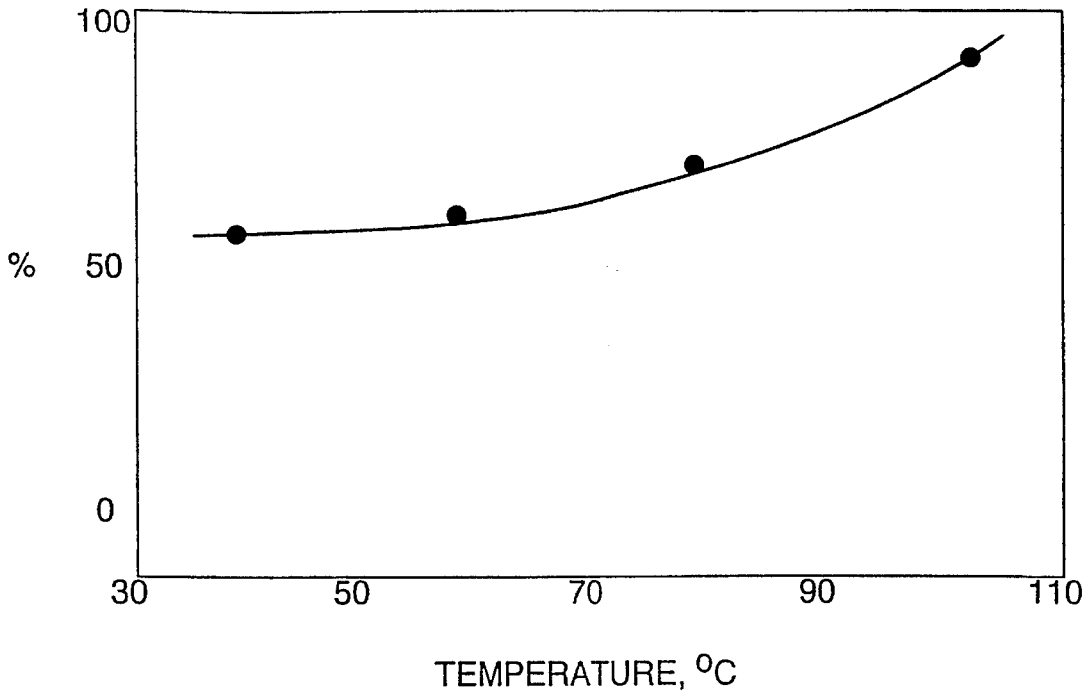
FIG. 2 is a graph depicting the effect of temperature on chlorine removal.
Figure 3:
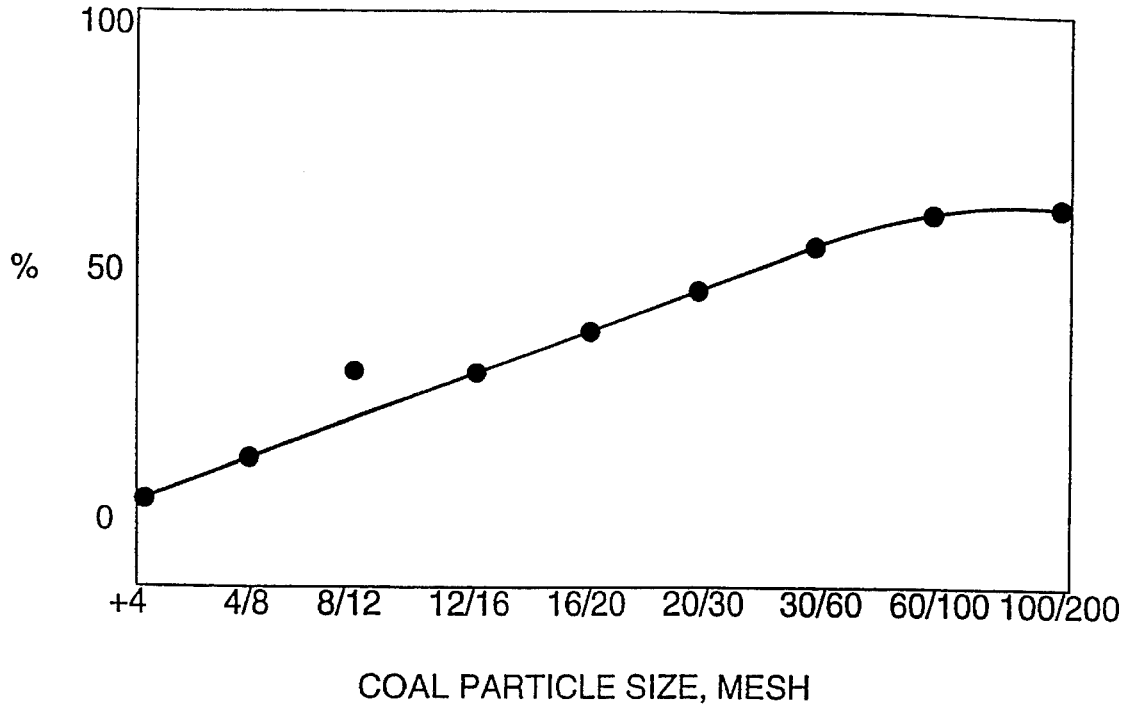
FIG. 3 is a graph depicting the effect of coal particle size on chlorine removal.
Figure 4:
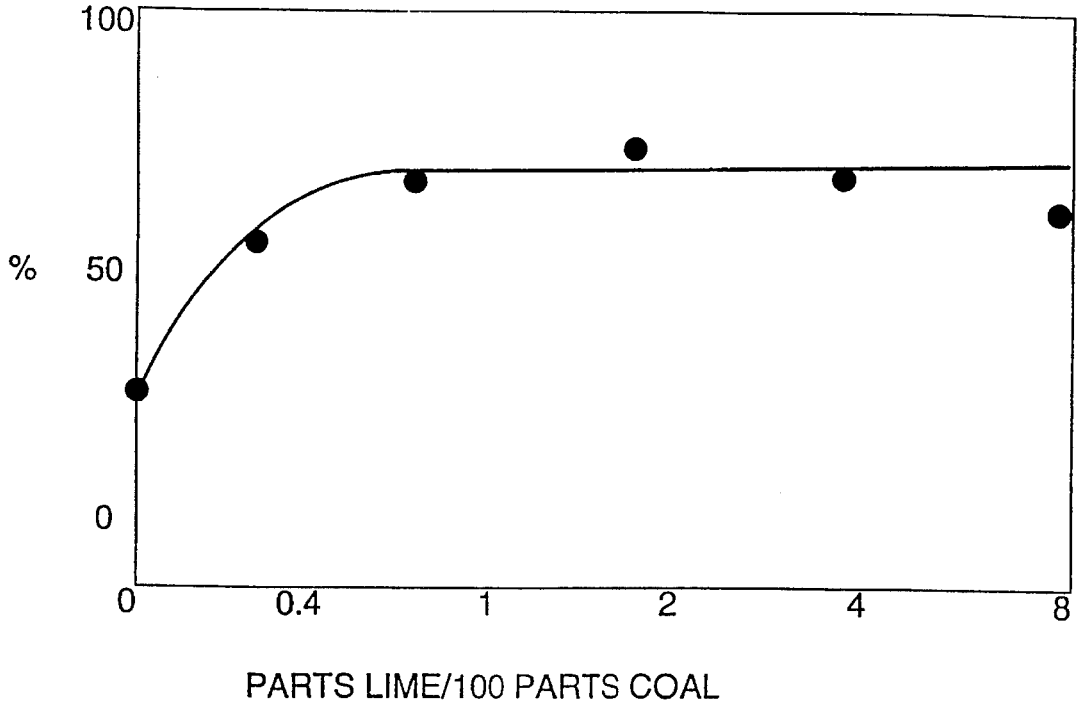
FIG. 4 is a graph depicting the effect of lime concentration on chlorine removal.

Methods and compositions are provided for the treatment of coal comprising high levels of sulphur and chlorine to produce a coal that, upon combustion, releases reduced amounts of sulphur dioxide and hydrogen chloride gas as compared with emissions from untreated coal. The method of this invention generally includes washing the coal with an ionic suspension, i.e. an ionicwash. The washed coal is then separated from the ionic wash. Upon combustion of the treated coal, comparatively reduced levels of sulphur dioxide and hydrogen chloride gas are produced.

The ionic wash of the subject invention serves two distinct purposes: 1) the reduction in hydrogen chloride gas emissions upon combustion and 2) the reduction in sulphur dioxide gas emissions upon combustion. The two purposes will be discussed in turn below.

The first purpose is to reduce the emissions of hydrogen chloride gas upon combustion of coal by reducing the amount of organic chlorine present in the coal. Though not wishing to be limited to a particular theory, the anion of the ionic wash serves this purpose by exchanging with the chloride anion paired with the organic positive groups present in the coal. Thus, the anions in the wash displace the chloride anions on the coal surface and the displaced chloride anions enter the wash. Upon separation of the washed coal from the wash, the concentration of organic chlorine present in the coal is significantly reduced.

Any suitable anion that is capable of pairing with calcium or magnesium cation to form the ionic wash may be used. The anion used in the ionic wash will be one that, upon exchange with the chlorine on the coal, will not give rise to an alternative pollutant emission upon combustion of the treated coal. Suitable anions include hydroxide, carbonate, bicarbonate and the like, preferably hydroxide.

The cation of the ionic wash serves the second purpose of the treatment, i.e. the reduction of sulphur dioxide emissions upon combustion of the coal. Suitable cations for use in the ionic wash are calcium and magnesium, preferably calcium. Upon washing the coal with the ionic wash, the cation is sorbed onto the surface of the coal. Following separation of the ionic wash from the treated coal, the cation remains on the coal surface. Upon combustion of the treated coal, the cation reacts with the sulphur present in the coal to form a sulphate. The resultant sulfate remains substantially in the ash. Concomitant with the formation of calcium sulfate, sulphur present in the coal is unable to form sulphur dioxide upon combustion of the coal. Consequently, sulphur dioxide emissions upon combustion of the treated coal are reduced in comparison to emissions upon combustion of untreated coal.

The concentration of the ionic wash will be any concentration capable of efficiently removing the chlorine present in the coal. The optimum concentration will usually be determined taking specific economic factors into account, e.g. cost of materials, budgetary constraints and the like. Typically, the concentration of the ionic wash will range from about 0.1 to 1 parts ion/100 parts coal, preferably 0.4 to 1.0 parts ion/100 parts coal.

The ionic wash may further include a surfactant which aids in the removal of chlorine from the coal. A suitable surfactant for this purpose is a caustic stable wetting agent. The surfactant should be effective in high ionic strength, alkaline solutions. Examples of suitable surfactants include alkyl polyoxyalkylene ethers, and the like.

The subject process may further include the application of sonic energy during the wash to increase the rate of removal of chlorine from the coal. Use of sonic energy in conjunction with the wash process may allow for effective treatment at reduced washing temperatures and/or shorter washing times.

The coal comprising high sulphur and chlorine will typically be reduced in size prior to washing. Typically, the coal will be reduced to sizes ranging from about 16 to 200 mesh, preferably 60 to 200 mesh. The coal may be reduced to the appropriate treatment size by any convenient means, including crushing, grinding and other means well known in the art.

The coal is washed for a sufficient time to remove a significant amount of the chlorine present in the coal. By significant amount is meant any amount of chlorine needed to be removed in order to reduce the hydrogen chloride gas emissions to an acceptable level, as determined by the operator, upon combustion of the treated coal. Washing times may range from 5 to 60 min, preferably 15 to 60 min.

The temperature of the ionic wash may vary over a wide range of temperatures and will be determined by many factors which affect a particular treatment process, i.e. cost limitations and the like. Typically, the temperature will range from 40° to 100° C. preferably 40° to 95° C.

The following examples are offered by way of illustration and not by way of limitation.

Experimental

Example 1

Chlorine Removal from Coal as a Factor of Temperature and Duration of Calcium Hydroxide ($Ca(OH)_2$) Wash Raw coal containing on average 1200 ppm chlorine was washed in a preparation plant at the mine resulting in pre-treated coal containing 600 ppm chlorine. The pre-treated coal was then washed with a calcium hydroxide wash solution at various temperatures and temporal durations yielding the following results:

TABLE 1

| Time | Temperature 70° F. | Temperature 200° F. |
|---|---|---|
| 15–30 min. | <30% chlorine removal | 60–65% chlorine material |
| 60 min. | * | >90% chlorine removal |

*denotes that results were not obtained

Example 2

Sulphur Retention in the Ash of Combusted Treated Coal

Treated coal as in Example 1 was combusted at 1500° F. in a muffle furnace. The temperature was raised to 1500° F. slowly to prevent coal from splattering out of the crucible. At least 75% of the sulphur present in the treated coal was retained in the ash following combustion. The sulphur content of the coal and the ash following combustion was determined using a Perkin Elmer sulphur analyzer.

It was noted that sulphur dioxide gas was emitted from the combusting coal when the temperature was between 350° F. and 700° F.

It is apparent that a relatively simple and efficient method of treating coal to reduce sulphur dioxide and hydrogen chloride gas emissions upon combustion is provided. The method employs washing the coal with an ionic wash, such as calcium hydroxide, for a suitable time to remove a significant amount of chlorine from the coal and to sorb calcium cation onto the coal surface. Upon combustion, reduced levels of hydrogen chloride and sulphur dioxide emissions are produced as compared to the emissions produced upon combustion of untreated coal.

All publications and patent applications cited in this specification are herein incorporated by reference as if each individual publication or patent application were specifically and individually indicated to be incorporated by reference.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

What is claimed:

1. A method of treating coal to reduce the emissions of sulphur dioxide and hydrogen chloride gas upon combustion, said method consisting of:

washing said coal with an ionic wash, wherein the cation of said ionic wash is selected from the group consisting of calcium and magnesium and the anion of said ionic wash is selected from the group consisting of hydroxide, carbonate and bicarbonate, wherein the temperature of said ionic wash ranges from 40° to 100° C.; and separating said washed coal from said ionic wash;

whereby upon combustion of said washed coal, reduced emissions of sulphur dioxide gas and hydrogen chloride gas are produced as compared to the emissions produced upon combustion of untreated coal.

2. The method according to claim 1, wherein said coal ranges in size from about 16 to 200 mesh.

3. The method according to claim 1, wherein said ionic wash has a concentration ranging from about 0.1 to 1.0 parts ion/100 parts coal.

4. The method according to claim 1, wherein said coal is washed for a time period ranging from about 5 to 60 min.

5. A method of treating coal to reduce the emissions of sulphur dioxide and hydrogen chloride gas upon combustion, said method consisting of:

washing said coal with an ionic wash, wherein the cation of said ionic wash is selected from the group consisting of magnesium and calcium and the anion of said ionic wash is selected from the group consisting of hydroxide, carbonate and bicarbonate, wherein the temperature of said ionic wash ranges from 40° to 100° C. and said ionic wash solution optionally includes a caustic-stable wetting agent; and separating said washed coal from said ionic wash;

whereby upon combustion of said washed coal, reduced emissions of sulphur dioxide gas and hydrogen chloride gas are produced as compared to the emissions produced upon combustion of untreated coal.

6. The method according to claim 5, wherein said caustic-stable wetting agent is an alkyl polyoxyalkylene ether.

7. The method according to claim 5, wherein said ionic wash has a concentration ranging from 0.4 to 1.0 parts ion/100 parts coal.

8. The method according to claim 5, wherein said coal ranges in size from 60 to 200 mesh.

9. The method according to claim 5, wherein said coal is washed for 15 to 60 minutes with said ionic wash.

10. A method of treating coal to reduce the emissions of sulphur dioxide and hydrogen chloride gas upon combustion, said method consisting of:

washing said coal with a calcium hydroxide wash for 15–60 minutes, wherein said calcium hydroxide is present in a concentration ranging from 0.4 to 1.0 parts calcium hydroxide/100 parts coal, the temperature of said calcium hydroxide wash ranges from about 40° to 100° C. and said calcium hydroxide wash further comprises a caustic-stable wetting agent; and separating said washed coal from said calcium hydroxide wash;

whereby upon combustion of said washed coal, reduced emissions of sulphur dioxide gas and hydrogen chloride gas are produced as compared to the emissions produced upon combustion of untreated coal.

* * * * *